United States Patent [19]

von der Eltz

[11] 4,067,211

[45] Jan. 10, 1978

[54] DEVICE FOR THE EVEN CONTINUOUS IMPREGNATION OF TEXTILES IN ROPE FORM

[75] Inventor: Hans-Ulrich von der Eltz, Frankfurt am Main, Germany

[73] Assignee: Hans-Ulrich von der Eltz, Frankfurt am Main, Germany

[21] Appl. No.: 748,942

[22] Filed: Dec. 9, 1976

[30] Foreign Application Priority Data

Dec. 15, 1975 Germany ..... 2556487

[51] Int. Cl.[2] ..... D06B 1/02

[52] U.S. Cl. ..... 68/21; 26/19; 68/43; 68/62; 68/175; 68/205 R

[58] Field of Search ..... 68/19, 21, 43, 62, 175, 68/205 R; 26/19, 20, 21; 28/5

[56] References Cited

U.S. PATENT DOCUMENTS

| | | | |
|---|---|---|---|
| 1,705,919 | 3/1929 | Hinnekens | 68/205 R |
| 2,149,708 | 3/1939 | von Recklinghausen et al. | 68/62 X |
| 3,255,617 | 6/1966 | Bisang | 68/175 |
| 3,315,501 | 4/1967 | Muller | 68/175 X |
| 3,324,486 | 6/1967 | Kurosaki | 68/62 X |

*Primary Examiner*—Philip R. Coe
*Attorney, Agent, or Firm*—Connolly and Hutz

[57] ABSTRACT

A device for the even, continuous impregnation of textile rope wherein at least two vertically spaced spray tubes spray impregnating liquor onto the rope which then passes to double conical shaped impregnation element disposed below the sprays; transport rollers below the impregnation element convey the rope and underneath the transport rollers, a compression compartment compresses the rope which is then passed in narrow loops around staggered rollers for fulling.

1 Claim, 8 Drawing Figures

DEVICE FOR THE EVEN CONTINUOUS IMPREGNATION OF TEXTILES IN ROPE FORM

The present invention relates to a device for the even, continuous impregnation of textiles in rope form.

Devices for the continuous impregnation of textile webs in rope form with impregnation liquors have been known for a long time and, so far, have met all the requirements. The continuous application of a certain amount of impregnation liquor to the textile rope was not necessary, but it was sufficient to impregnate this rope with a large amount of liquor and to squeeze off the excess only at the surface. The impregnation of a textile web with a liquor, if it had to be continuous, has so far been effected over the full width by immersing the rope into the liquor and be evenly squeezing off the liquor over the full width of the textile material, or by the direct application by means of spraying, foaming and with the aid of different methods.

It is the object of the invention to apply a given, relatively small amount of liquor continuously to a textile web in rope form and to disperse it therein.

This is especially required for textiles in tubular form, in which case the tube has not to be cut open, for example, tricot material, but also flat wovens or knits. For the latter, the problem to be solved always was how to maintain the whole width of the textile webs, to allow their passage free from creases and to avoid the impairment of the edges of the web caused by the machine pieces required for the maintenance of the width. It must also be taken into account, that machines, which are designed for large textile webs, always occupy distinctly more space.

Now, it was found, that textile webs in rope form can be impregnated evenly and continuously by means of the device (FIG. 1) hereinafter described.

DETAILED DESCRIPTION

Liquor pick-up is controllable within the range of from 50 to 100 %. The textile rope passes vertically (from top to bottom) through two or three horizontally arranged circular spray nozzles 1 and a dosed amount of liquor is applied by spraying on to the textile rope 10. The spray nozzles 1 have a great number of perforations of 1–2 mm diameter at the inner surface of the circular tubes. The liquor is fed into the tubes via a dosage device (for example, a pump) not shown under pressure. It leaves the perforations in the form of thin jets or fine drops (fog) and contacts the textile rope from all sides. The material charged with the liquor enters a variable double cone 2, which is twisted so much as to leave an opening just wide enough to pull the rope through. The upper part of the cone 2*a* is bigger than the lower one 2*c* and serves for collecting the excess liquor wiped off from the rope at the narrowest place 2*b* of the double cone. It simultaneously serves for the penetration of the liquor into the interior of the textile rope. The liquor is fed over the spray nozzles 1 in such a way that it reaches a certain level in the upper part of the cone 2*a*. So, the rope is immersed into the liquor. The liquor itself is partially dewatered at the narrow place of the double cone and pressed into the rope, an operational method similar to that of a padding machine.

Adjustable double cones serving as self-sealing pressure slots for textile ropes on pressure chambers have already been described German Offenlegungsschrift No. 25 37 665.2. Their use as impregnation element is not known. The construction of these devices is illustrated in detail in FIGS. 2*a*, 2*b*, 2*c*, 2*d* and 3.

When used as pressure slot, this element can be mounted in any desired position, however, its use as impregnation element requires the vertical arrangement. As it is designed as asymmetric double cone, it can serve as liquor container and as squeezing device at the same time.

Figure 1:
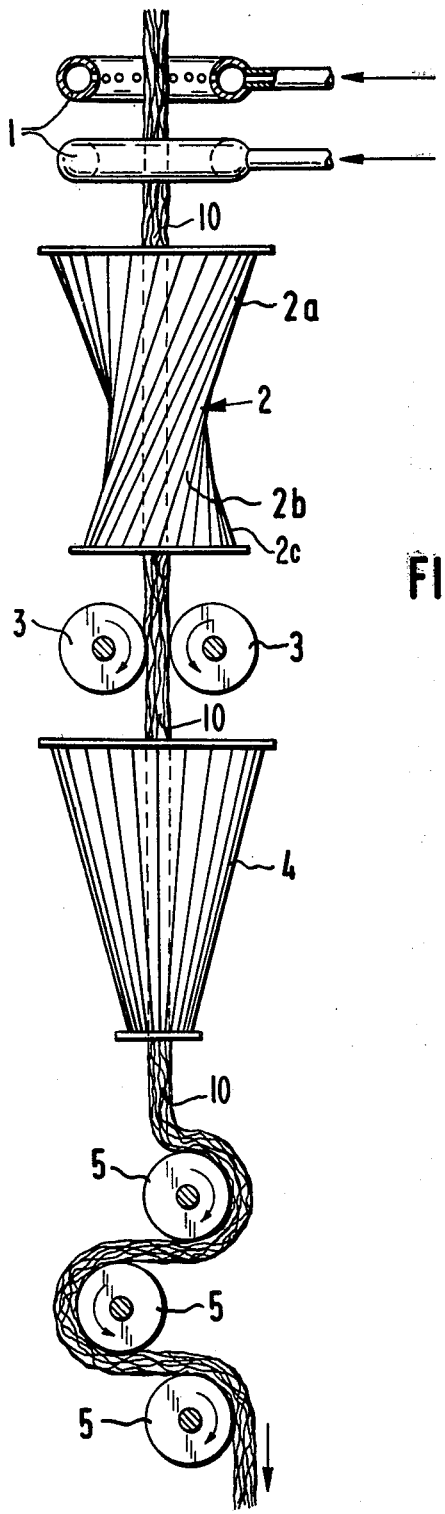
FIG. 1 is a schematic elevational view of a textile rope impregnating and fulling device illustrating an embodiment of this invention.
Figure 2A:
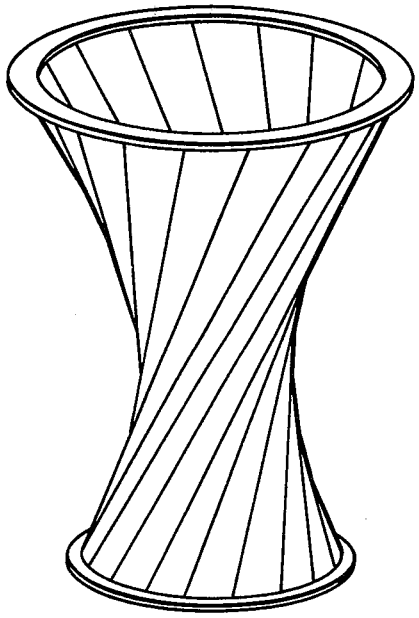
FIG. 2*a* is a pictorial view illustrating an adjustable double cone impregnation element of this invention.
Figure 2C:
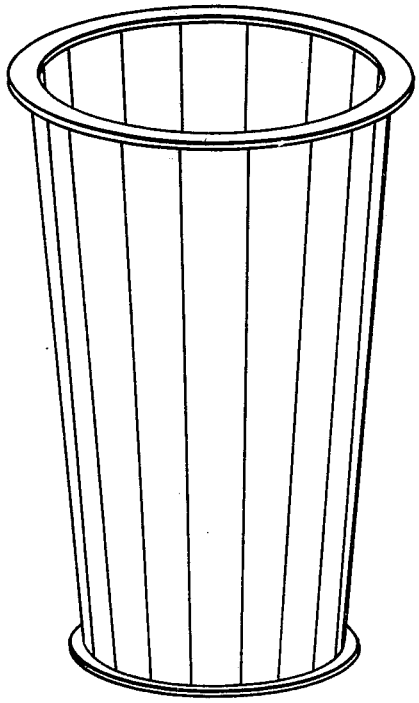
FIG. 2*c* is a pictorial view of a funnel shaped adjustable cone of this invention.
Figure 2B:
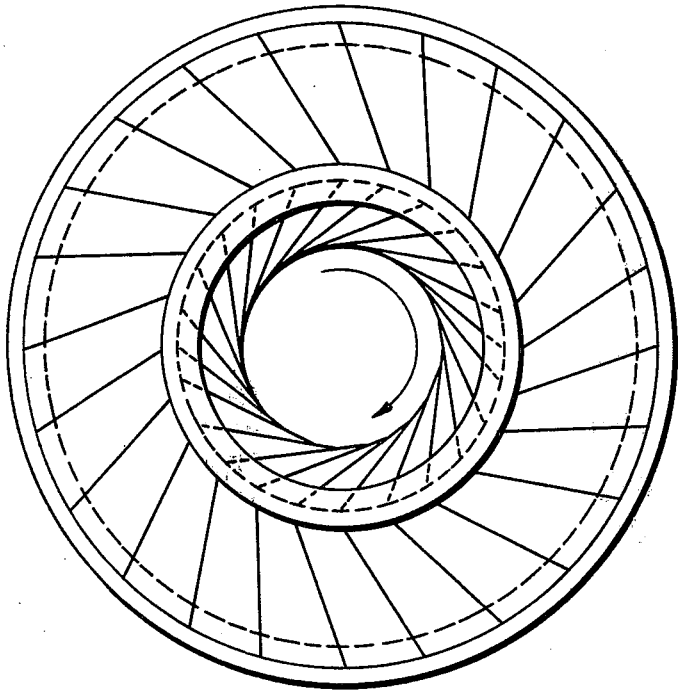
FIG. 2*b* is a bottom plan view of the cone shown in FIG. 2*a;*
Figure 2D:
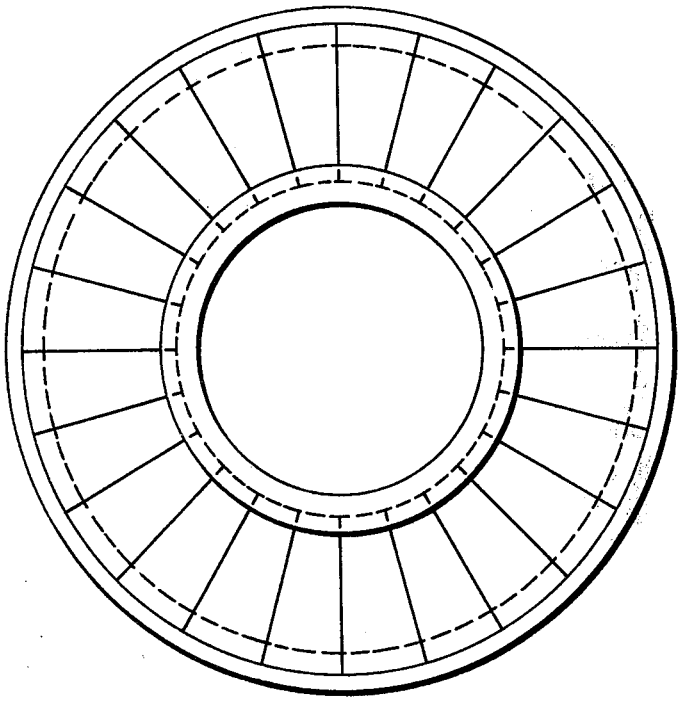
FIG. 2*d* is a bottom plan view of the cone shown in FIG. 2*c;*
Figure 3:
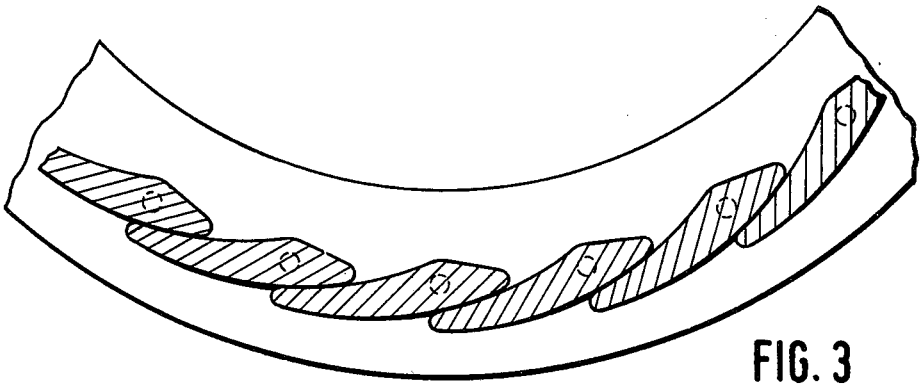
FIG. 3 is a fragmental cross-sectional view illustrating a detail of the double cone lamellas arrangement.
Figure 4:
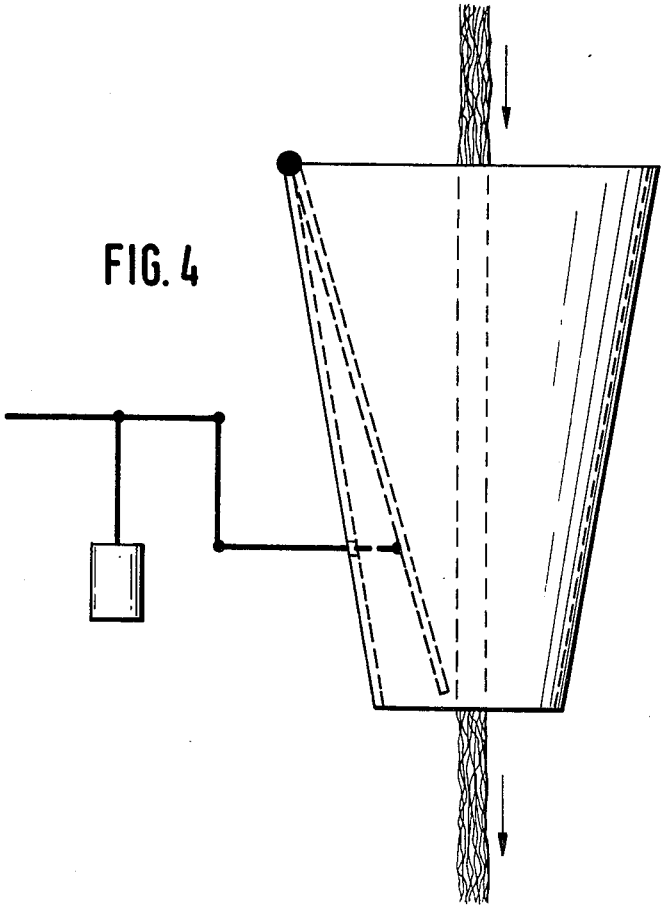
FIG. 4 is a side elevational view of a compression compartment element of this invention having a stuffer trap changeable with lever and weight to narrow the compression channel.
Figure 5:
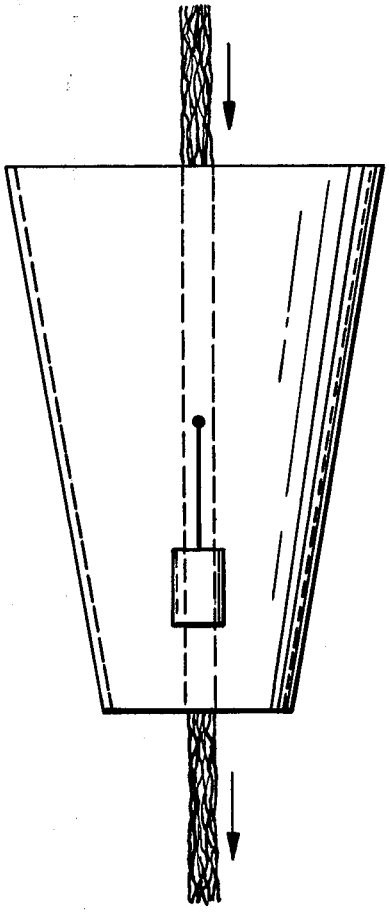
FIG. 5 is an end elevational view of the compression compartment shown in FIG. 4.

The textile rope 10 is passed through the sprayers 1 and through the double cone 2 by means of transport rollers 3 mounted under the double cone. The partially dewatered textile rope passes over these rollers to be introduced into an optionally variable compression compartment 4. The simplest one is a funnel in which the rope is compressed. The passage of the rope is continued by the pressure of its own weight and by the following pull exercised by the following fulling rollers 5. The compression compartment may also be in the form of a fulling machine FIGS. 4, 4*a*). The transport rollers 5 connected and run after the compression compartments are arranged in a staggered manner such that the textile rope is fulled when it passes through, which gives an even distribution of the liquor.

The textile rope impregnated in such a manner can be subjected to a further treatment.

The device has the following advantages:

Only a given amount of liquor within the range of from 50 to 100%, calculated on the weight of the material, is introduced into the textile rope. If heating follows, the heating times are shorter and energy is saved compared to a rope just impregnated, the impregnation being effected with a liquor pick-up generally beyond 200%.

The dosage is easy depending on the passage rate of the material and on the weight per meter. After all, the liquor level has to be kept constant in the upper part of the double cone.

The device is extremely space-saving.

It was surprising and could not have been foreseen, that the device allows an even distribution of the liquor, first applied only to the surface of the rope, in the textile rope.

I claim:

1. A device for the even, continuous impregnation of a textile rope comprising at least two, vertically spaced circular jet or spray tubes for spraying said rope, each tube being horizontally disposed; an adjustable, double conical shaped device disposed vertically below said jet or spray tubes and serving as an impregnation element for said rope; a pair of transport rollers disposed vertically below said double conical shaped device for continuously conveying said rope through said jet or spray tubes and then through said double conical shaped device; a compression compartment disposed vertically below said pair of transport rollers for compressing said rope; and at least three rollers arranged in a staggered manner below said compression compartment for passing said rope in narrow loops for fulling thereof.

* * * * *